US008863727B2

(12) United States Patent
Jalal et al.

(10) Patent No.: US 8,863,727 B2
(45) Date of Patent: Oct. 21, 2014

(54) PIEZOELECTRIC FUEL INJECTOR SYSTEM, METHOD FOR ESTIMATING TIMING CHARACTERISTICS OF A FUEL INJECTION EVENT

(75) Inventors: Syed S. Jalal, Columbus, IN (US); Douglas W. Memering, Columbus, IN (US); Richard E. Reisinger, Columbus, IN (US); Edward Benjamin Manring, Columbus, IN (US); Jesus Carmona-Valdes, Columbus, IN (US); Anthony A. Shaull, Columbus, IN (US); Shankar Venkataraman, Columbus, IN (US); William David Daniel, Scipio, IN (US)

(73) Assignee: Cummins Intellectual Property, Inc., Minneapolis, MN (US)

( * ) Notice: Subject to any disclaimer, the term of this patent is extended or adjusted under 35 U.S.C. 154(b) by 760 days.

(21) Appl. No.: 13/112,997

(22) Filed: May 20, 2011

(65) Prior Publication Data

US 2012/0048239 A1 Mar. 1, 2012

Related U.S. Application Data

(60) Provisional application No. 61/346,468, filed on May 20, 2010.

(51) Int. Cl.

| | |
|---|---|
| ***F02M 37/04*** | (2006.01) |
| ***F02M 57/00*** | (2006.01) |
| *F02M 51/06* | (2006.01) |
| *F02D 41/00* | (2006.01) |
| *F02D 41/20* | (2006.01) |

(52) U.S. Cl.

CPC ..... *F02M 51/0603* (2013.01); *F02M 2200/244* (2013.01); *F02D 2041/2058* (2013.01); *F02D 41/2096* (2013.01); *F02M 57/005* (2013.01); *F02M 2200/704* (2013.01); *F02D 2041/2055* (2013.01); *F02D 2041/2051* (2013.01)

USPC ..... 123/472

(58) Field of Classification Search

USPC ..... 123/472, 445, 494, 496, 498, 478; 310/366, 317, 328; 239/5, 102.1, 239/102.2, 533.2, 533.3, 585.1–585.5

See application file for complete search history.

(56) References Cited

U.S. PATENT DOCUMENTS

| | | | |
|---|---|---|---|
| 6,253,736 | B1 | 7/2001 | Crofts |
| 6,318,342 | B1 | 11/2001 | Simon et al. |

(Continued)

FOREIGN PATENT DOCUMENTS

| | | | |
|---|---|---|---|
| DE | 31 03 061 | A1 | 8/1982 |
| EP | 1 169 568 | B1 | 7/2007 |

(Continued)

OTHER PUBLICATIONS

Notification of Transmittal of the International Search Report and the Written Opinion of the International Searching Authority, or the Declaration dated Nov. 29, 2011; International Application No. PCT/JP2011/037468.

*Primary Examiner* — Hieu T Vo

(74) *Attorney, Agent, or Firm* — Faegre Baker Daniels LLP

(57) ABSTRACT

This disclosure provides a fuel injector system and method in which the timing of events in during period of fuel injection of a piezoelectric-actuated fuel injector are estimated based on sensed forces within the injector. The force sensor is positioned between a piezoelectric actuator and a hydraulic link assembly mechanically coupled with the piezoelectric actuator, and the force sensor operable to output a signal corresponding to forces between the piezoelectric actuator and the hydraulic link assembly. From information contained in the sensor output signal, timing in the injection period of at least one fueling characteristic based can be estimated to allow for adjusting fuel injector characteristics to compensate for variations affecting fuel injection, such as manufacturing tolerances, environmental conditions, and deterioration/wear.

16 Claims, 9 Drawing Sheets

(56) References Cited

U.S. PATENT DOCUMENTS

| | | | | |
|---|---|---|---|---|
| 6,837,221 | B2 | 1/2005 | Crofts et al. | |
| 7,077,379 | B1 | 7/2006 | Taylor | |
| 7,406,951 | B2 * | 8/2008 | Stoecklein | 239/102.2 |
| 7,456,545 | B2 | 11/2008 | Huber et al. | |
| 7,528,524 | B2 | 5/2009 | Rueger et al. | |
| 8,201,543 | B2 * | 6/2012 | Morris et al. | 123/494 |
| 8,479,711 | B2 * | 7/2013 | Morris et al. | 123/494 |
| 2003/0106533 | A1 | 6/2003 | Crofts et al. | |
| 2005/0072854 | A1 | 4/2005 | Baranowski et al. | |
| 2006/0255695 | A1 | 11/2006 | Endriss | |
| 2009/0063010 | A1 | 3/2009 | Nakata et al. | |
| 2009/0063013 | A1 | 3/2009 | Nakata et al. | |
| 2009/0063016 | A1 | 3/2009 | Nakata et al. | |
| 2011/0120423 | A1 | 5/2011 | Borchsenius et al. | |

FOREIGN PATENT DOCUMENTS

| | | | |
|---|---|---|---|
| JP | H9-264181 | A | 10/1997 |
| JP | H10-288119 | A | 10/1998 |
| JP | 2008-215186 | A | 9/2008 |
| WO | 2005/041315 | A1 | 5/2005 |

* cited by examiner

PIEZOELECTRIC FUEL INJECTOR SYSTEM, METHOD FOR ESTIMATING TIMING CHARACTERISTICS OF A FUEL INJECTION EVENT

RELATED APPLICATIONS

This application claims benefit of priority to Provisional Patent Application No. 61/346,468, filed on May 20, 2010, the entire contents of which are hereby incorporated by reference.

FIELD OF THE INVENTION

The invention relates to fuel injection system, to a method for estimating timing injection events, and to controlling fuel injection components based on estimated event timings.

BACKGROUND

In many fuel supply systems applicable to internal combustion engines, fuel injectors are used to inject fuel pulses into the engine combustion chamber. A commonly used injector is a closed-nozzle injector which includes a nozzle assembly having a spring-biased nozzle valve element positioned adjacent the nozzle orifice for allowing fuel to be injected into the cylinder. The nozzle valve element also functions to provide a deliberate, abrupt end to fuel injection, thereby preventing a secondary injection which causes unburned hydrocarbons in the exhaust. The nozzle valve is positioned in a nozzle cavity and biased by a nozzle spring so that when an actuated force exceeds the biasing force of the nozzle spring, the nozzle valve element moves to allow fuel to pass through the nozzle orifices, thus marking the beginning of the injection event.

SUMMARY

This disclosure provides a piezoelectric-actuated fuel injection system that can estimate fuel injection timing events in a fuel injection period from characteristics of a signal corresponding to sensed force in the injector, and a method for estimating timing injection events during the fuel injection period.

In an aspect of the disclosure, a piezoelectric-actuated fuel injector system for injecting fuel into a combustion chamber of an internal combustion engine includes an injector body including a plunger, a nozzle housing having a nozzle cavity, injector body and said nozzle housing, and an injector orifice communicating with one end of said nozzle cavity to inject fuel into the combustion chamber. The system includes a nozzle valve element positioned in the nozzle cavity adjacent the injector orifice, the nozzle valve movable between an open position in which fuel flows through the injector orifice into the combustion chamber and a closed position in which fuel flow through the injector orifice is blocked. A piezoelectric actuator is movable to expand in a first direction and to contract in a second direction. A hydraulic link assembly is positioned within the nozzle cavity and is operably connected with the piezoelectric actuator such that movement of the piezoelectric actuator in the first direction causes the nozzle valve element to move to the open position, and movement of the piezoelectric actuator in the second direction causes the valve element to move to the closed position. A force sensor is positioned between the piezoelectric actuator and the hydraulic amplifier assembly and is adapted to provide a signal indicative of forces between the piezoelectric actuator and the hydraulic amplifier assembly during a fuel injection period. A controller is adapted to receive the signal provided by the force sensor, identify at least one of a maximum value and a valley minima value of the monitored output signal, and estimate timing in the injection period of at least one fueling characteristic based on the at least one identified value.

In another aspect of the disclosure is a method of estimating timing characteristics of a fuel injection event of a piezoelectric-actuated fuel injector. The piezoelectric-actuated fuel injector includes a force sensor positioned between a piezoelectric actuator and a hydraulic link assembly mechanically coupled with the piezoelectric actuator, and the force sensor operable to output a signal corresponding to forces between the piezoelectric actuator and the hydraulic link assembly. The method includes monitoring a signal output from the force sensor the over an injection period of the piezoelectric-actuated fuel injector, identifying at least one of a maximum value and a local valley minimum value of the monitored output signal, and estimating timing in the injection period of at least one fueling characteristic based on the at least one identified value.

DETAILED DESCRIPTION

Many aspects of the disclosure are described in terms of sequences of actions to be performed by elements of a driver, controller, control module and/or a computer system or other hardware capable of executing programmed instructions. It will be recognized that in each of the embodiments, the various actions could be performed by specialized circuits (e.g., discrete logic gates interconnected to perform a specialized function), by program instructions, such as program modules, being executed by one or more processors (e.g., a central processing unit (CPU) or microprocessor), or by a combination of both. Logic of embodiments consistent with the disclosure can be implemented with any type of appropriate hardware and/or software, with portions residing in the form of computer readable storage medium with a control algorithm recorded thereon such as the executable logic and instructions disclosed herein, and can be programmed, for example, to include one or more look-up tables and/or calibration parameters. The computer readable medium can comprise a random access memory (RAM), a read-only memory (ROM), an erasable programmable read-only memory (EPROM or Flash memory), an optical fiber, and a portable compact disc read-only memory (CD-ROM), or any other solid-state, magnetic, and/or optical disk medium capable of storing information. Thus, various aspects can be embodied in many different forms, and all such forms are contemplated to be consistent with this disclosure.

Figure 1:
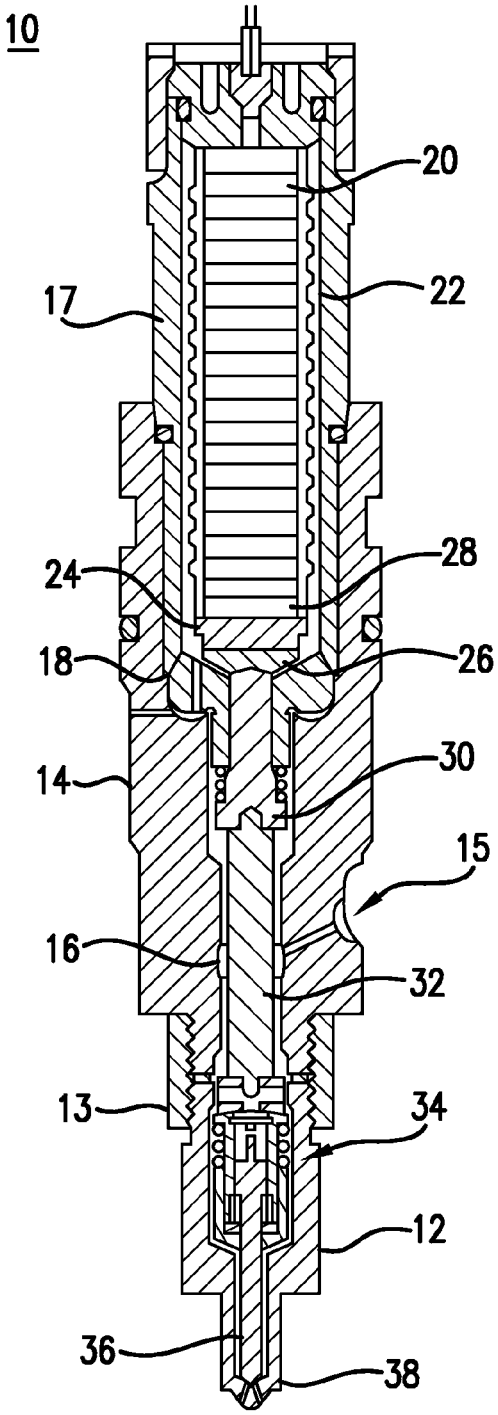
FIG. 1 is a diagram of a fuel injector according to an exemplary embodiment.

FIG. 1 is a diagram of an exemplary fuel injector 10 that includes a nozzle housing 12, a nozzle retainer 13, an injector body 14 including a fuel inlet 15 configured to supply fuel to fuel supply cavity 16. The fuel supply pressure may be within a pressure range of approximately 350-2700 bar. An upper actuator housing 17 is attached to an upper portion of the injector body 14 to be seated with a lower actuator housing 18. The upper actuator housing 17 includes a piezoelectric actuator 20, such as a piezoelectric stack, preloaded by corrugated tube 22, a piezoelectric adapter 24, and an actuator adaptor 26. A piezoelectric force sensor 28, for example, a piezoelectric force sensor chip made of a piezoelectric ceramic or other piezoelectric material, is located in the upper actuator housing 16 of fuel injector 10 and positioned between the piezoelectric actuator 20 and an upper plunger 30, and a lower plunger 32 housed in the injector body 14, although other embodiments can include a configuration in which a piezoelectric force sensor is positioned at another location in a fuel injector at which longitudinal forces and pressure of mechanical injection components can be sensed and voltage or current output that corresponds to the sensed force or pressure.

With activation of the piezoelectric actuator 20, the lower plunger 32 interacts with a hydraulic amplifier assembly 34, or "hydraulic link" included in a cavity in the nozzle housing 12 to cause a nozzle valve element (needle valve) 36 held in a seated engagement with a nozzle seat 38 in the nozzle housing 12 to open for the duration of activation and inject fuel through the orifice of the nozzle and into a combustion chamber of an internal combustion engine (now shown). More specifically with respect to the orientation of the fuel injector 10 shown in FIG. 1, the hydraulic amplifier assembly 34 amplifies the motion of the piezoelectric actuator 20 and reverses the motion of the needle valve 36 relative to the downward motion of the upper and lower plungers 30, 32 to move the needle valve 36 in an upward direction. Other components are provided as required to complete the injector assembly. Except for the new or different features described in this disclosure, the injector generally operates like the fuel injector described in U.S. Provisional Patent Application Ser. No. 61/185,779 filed on Jun. 10, 2009 entitled "Piezoelectric Direct Acting Fuel Injector with Hydraulic Link," the entire contents of which is hereby incorporated by reference.

During fuel injection, the piezoelectric force sensor 28 reacts to transient force in response to actuation of the piezoelectric actuator 20 and to the dynamics of the hydraulic amplifier to produce a voltage or current signal having a characteristic corresponding to sensed forces. In this way, this piezoelectric force sensor 28 acts as a force/pressure sensor inside the fuel injector 10. Upon analyzing the signature (i.e., characteristic) provided by the piezoelectric force sensor 28, fueling characteristics of an injection event can be captured accurately.

Figure 2:
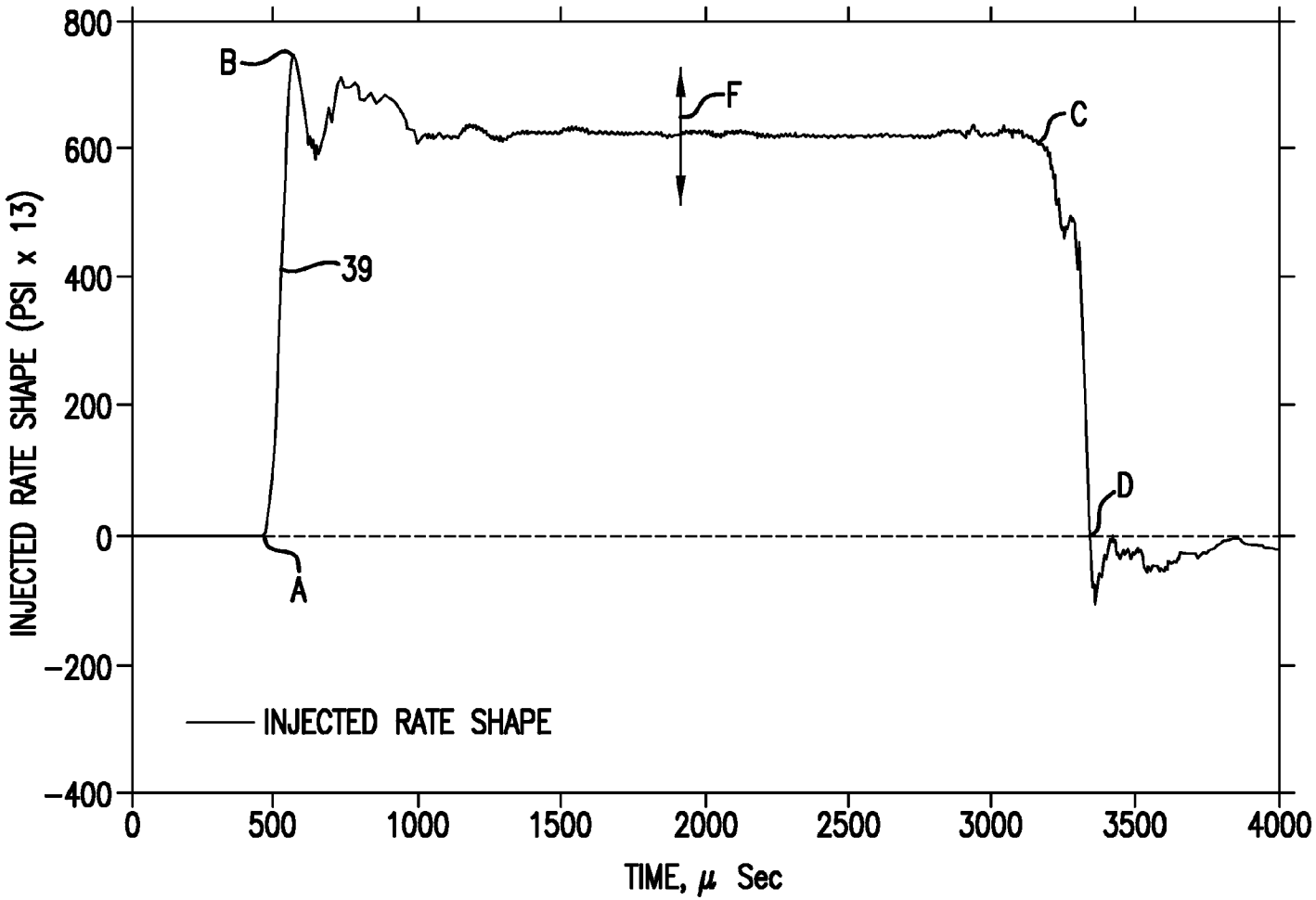
FIG. 2 is a graph showing an injected rate shape for a fuel injector.

FIG. 2 shows an exemplary injected shape rate curve 39 of a fuel injector over a period of injection, which was derived from measurements of a pressure transducer in a cylinder of the engine (not shown). It is to be understood that various factors in a fueling system configuration can result in corresponding changes to the magnitude, shape and event timing of a rate shape for an injector, such as rail pressure, nozzle pph (pounds per hour) etc. Embodiments of the disclosure provide a system and method that can predict timing events of an injected rate shape of a fuel injector, specifically, estimating the timing of start of injection (SOI) labeled as point A; estimating the timing of start of fully developed injection flow (SOCF) labeled as point B; estimating the timing of end of fully developed injection flow or end of cup flow (EOCF) labeled as point C; and/or estimating the timing of end of injection (EOI) labeled as point D. Additionally, the height of the rate shape (HOCF) labeled as F can be estimated along with the above timing estimates to construct a fairly accurate model of the injected rate shape of the fuel injector.

Figure 3:
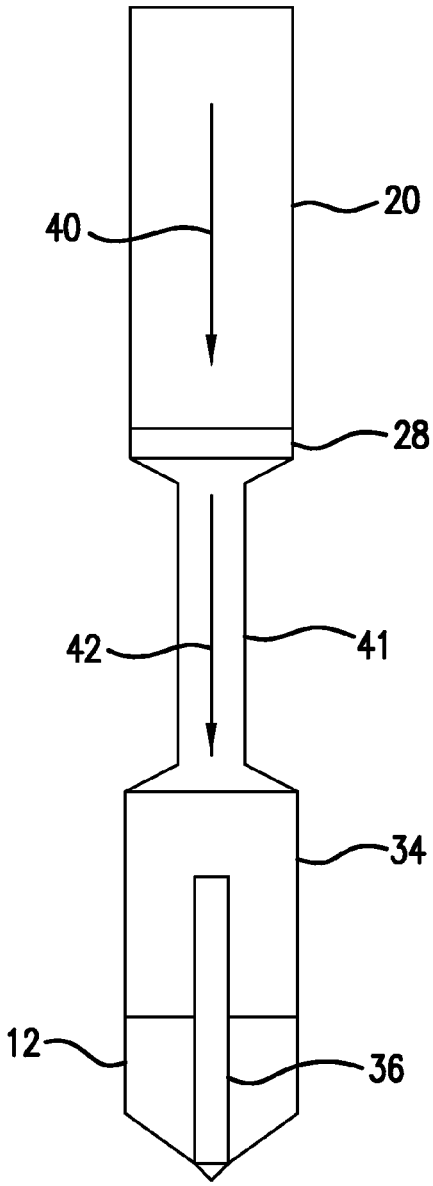
FIG. 3 is a simplified diagram of the fuel injector shown in FIG. 1.

FIG. 3 is a simplified diagram of the fuel injector shown in FIG. 1. As shown in FIG. 3, as the piezoelectric stack of the piezoelectric actuator 20 is energized, it extends in the direction of arrow 40 and pushes the piezoelectric force sensor 28 and injector components 41 (which represents collectively the components 24-26, 30 and 32 shown in FIG. 1) in the direction of arrow 42 mechanically against the pressure of the fuel in the common rail. During this state, the pressure of the intensifier chamber in the hydraulic amplifier assembly 34 increases and piezoelectric force sensor 28 provides a positive voltage due to compression. The voltage output from the piezoelectric force sensor 28 starts from an unloaded voltage value corresponding to a state when the piezoelectric actuator is not energized (i.e., in a retracted state), and once the actuator 20 is energized, the voltage output from the sensor 28 rises rapidly to a maximum value when the needle valve 36 begins to open, then settles down to a near constant positive level at SOCF time corresponding to point B when the needle valve 36 is fully open, has a knee point characteristic at a time when the ending of the injection event is initially sensed (i.e., when the piezoelectric actuator 20 is de-energized), has a local minima valley voltage value at the EOCF time corresponding to point C, and rises from the local minimum valley voltage value to an EOI time corresponding to point D, which can occur either when the sensor voltage crosses its unloaded voltage value on its way to a local maximum voltage value that is greater than or equal to the unloaded voltage value (e.g., greater or equal to zero volts) in the period of injection, or at the time a local maximum voltage value is reached after the timing of the local minimum valley voltage value if the local maximum voltage value is less than the unloaded voltage level.

Figure 4:
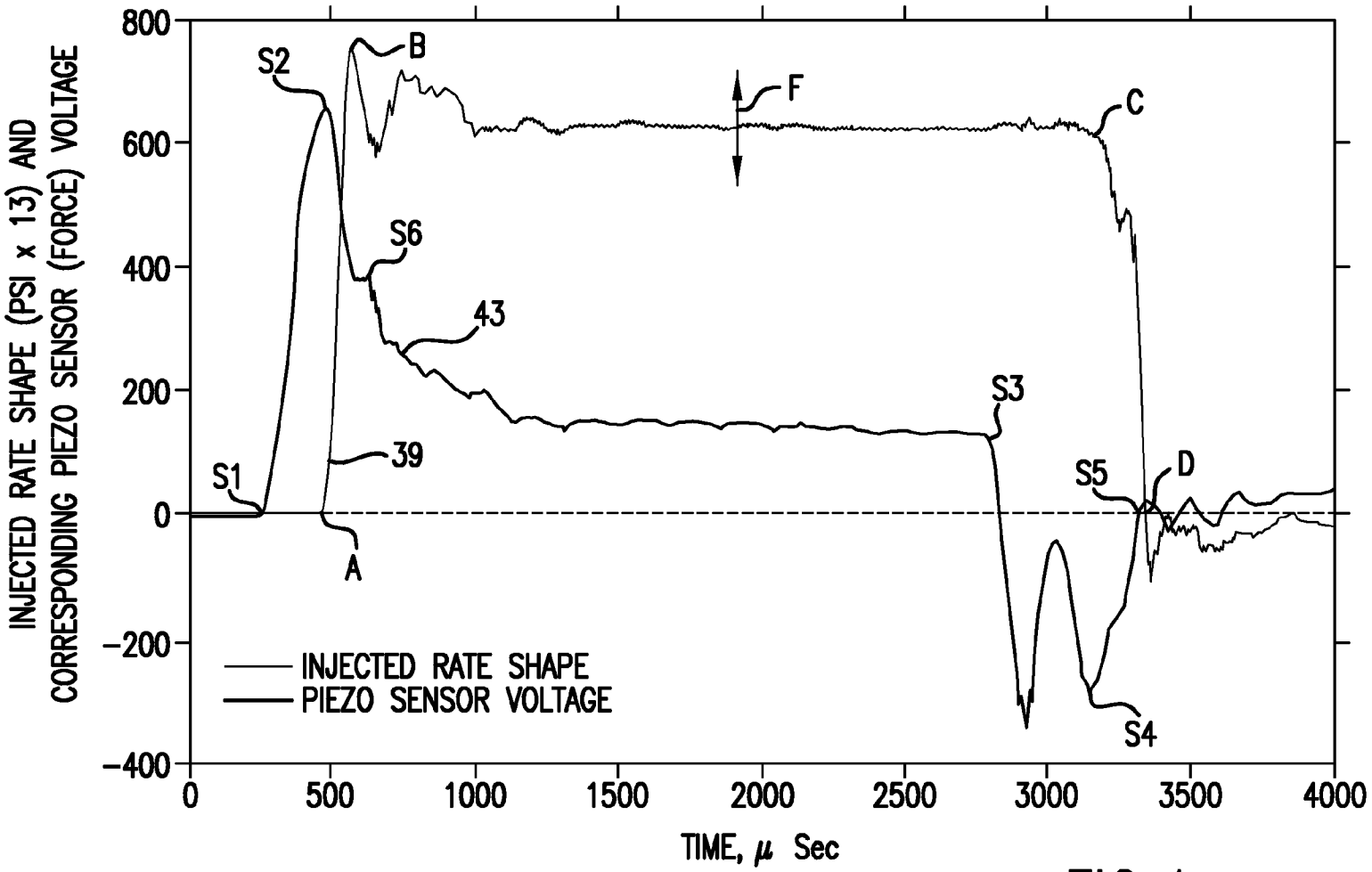
FIG. 4 is a graph showing a piezoelectric force sensor output voltage along with a corresponding injected rate shape curve of FIG. 2.

FIG. 4 shows the piezoelectric force sensor output voltage curve 43, along with the corresponding the injected rate shape curve 39. The identifiers S1 to S6 on the piezoelectric force output voltage curve 43 of the piezoelectric force sensor 28 corresponds to times of events of injection characteristics and the voltage output by the sensor 28 at those points. Point S1 corresponds to the timing of the event when the actuator starts pushing the hydraulic amplifier 34. Prior to time S1, the piezoelectric actuator 20 is not energized (unloaded), and thus the output of the piezoelectric force sensor 28 is at its unloaded voltage level. Point S2 is the maximum voltage output by the piezoelectric force sensor 28, which is about 200V in this exemplary embodiment, and occurs just after an energizing start of injection SOI signal is applied to the piezoelectric actuator 20. The timing of S2 corresponds to or reflects the timing of the needle opening or SOI, which also corresponds to the depicted point A of injected rate shape curve 39. Point S3 captures the timing as the piezoelectric actuator 20 is de-energized and the actuator starts to pull its force from the hydraulic amplifier 34 or as it starts to discharge. Point S4 corresponds to the time when needle starts to close, i.e., point S4 captures the EOCF corresponding to point C of the injected rate shape curve 39. S5 corresponds to the time when needle is fully closed i.e. captures the end of injection at D of the injected rate shape 39.

While FIG. 4 shows an unloaded voltage state of "zero" volts prior to loading (energizing) the piezoelectric actuator 20, the unloaded or non energized voltage level of the fuel injector 10 can be one or more voltage level values within a range of values about a predetermined unloaded voltage value. Use of the term "zero value" or unloaded value herein means an unloaded state in which no injection voltage is applied to energize the piezoelectric actuator 20 for injection. In some embodiments, for example, an unloaded state the voltage (or current) level of the output of sensor 28 prior to time A can be different or from the unloaded voltage at time D because the response of the piezoelectric force sensor 28 may oscillate about the steady state unloaded voltage, or approach the steady state unloaded voltage in a oscillatory and/or dampening way.

The physics behind the start of injection (SOI) corresponding to point S2 on piezoelectric sensor output voltage curve 43 will now be explained. As soon as the needle valve 36 opens, the intensifier pressure starts dropping and piezoelectric sensor voltage begins to decrease, and this event is SOI. As needle valve 36 starts to open, the intensifier pressure starts to drop and piezoelectric sensor voltage starts turning around, which indicates SOI shown as S2 in FIG. 4.

As the needle valve 36 opens more and more, fueling out through the nozzle increases and the injector body pressure decreases. Piezoelectric force sensor voltage output by the piezoelectric force sensor 28 captures these changes in body pressure in the characteristics of the piezoelectric sensor output voltage curve 43. Once the fueling settles to a fully developed flow, injector body pressure settles down and so does the voltage output of the piezoelectric force sensor 28, which is shown as the generally horizontal region of curve 43.

As the driver shuts down the piezoelectric actuator 20, the force pushed by the actuator begins to fade away, and consequently the net force acting on the needle valve 36 by hydraulic pressure starts to close the needle valve 36. The end of cup flow, EOCF, can be predicted from the signature of the output voltage of the piezoelectric force sensor 28, as point S4 in FIG. 4.

Figure 5:
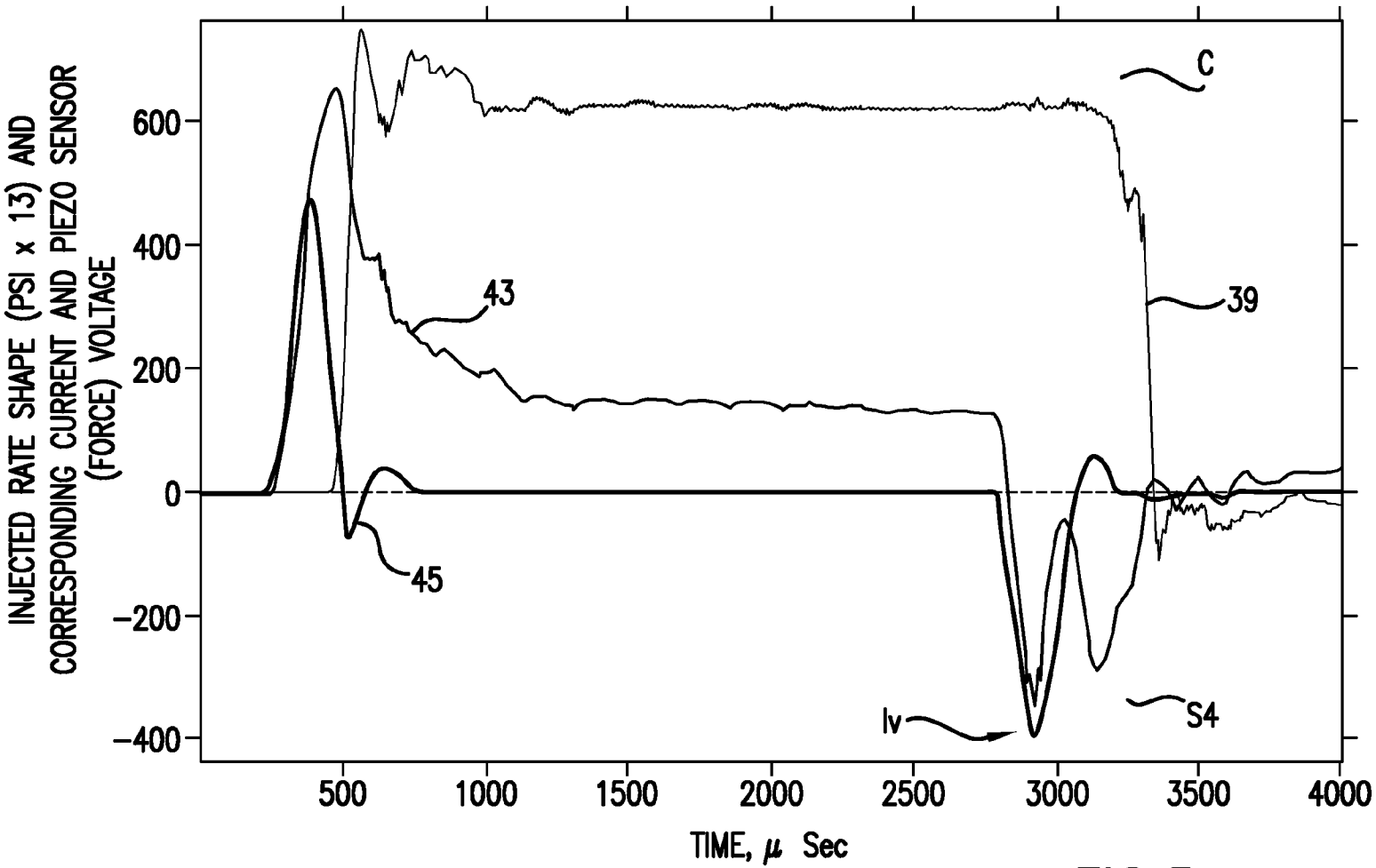
FIG. 5 is a graph showing an exemplary current curve of piezoelectric actuator along with the piezoelectric force sensor output voltage and corresponding injected rate shape curves of FIG. 4.
Figure 6:
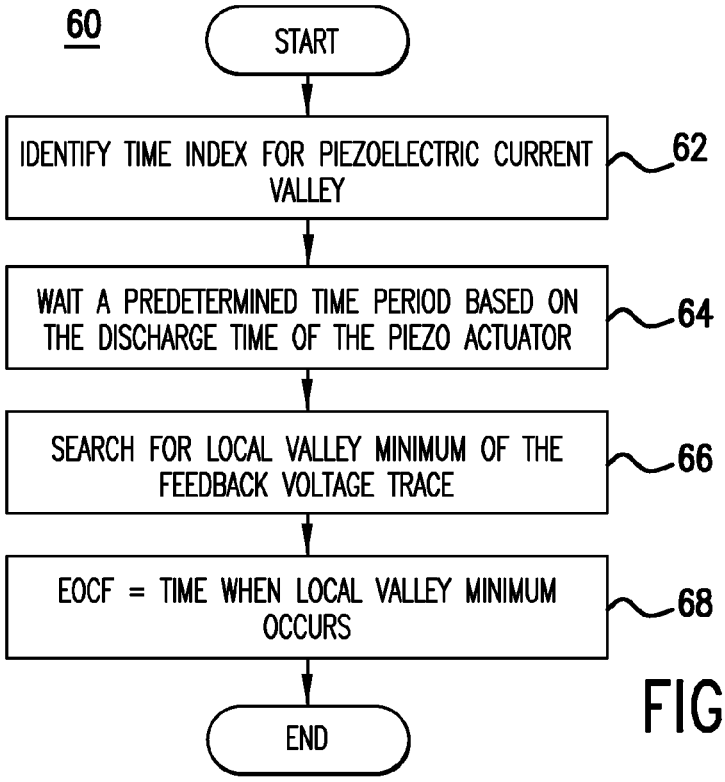
FIG. 6 is a diagram of a process for estimating the timing of the end of cup flow during a fuel injection event according to an exemplary embodiment.

FIG. 5 is a graph showing the injected rate shape curve 39, the piezoelectric sensor output voltage curve 43, and a current curve 45 of the piezoelectric actuator 20. FIG. 6 is a process diagram of an exemplary process 60 of estimating EOCF. As shown in FIG. 6, process 62 identifies the time index for the piezoelectric current valley (minimum current amplitude during discharging). In FIG. 5, the identified piezoelectric current valley is at Iv. Next, in process 64 a wait time of predetermined time period based on a function of the discharge time (e.g., driver shut down time or fall time) of the piezoelectric actuator 20 is allowed to elapse. In an exemplary application, the wait time is about 50 microseconds. In process 66, a search begins for the valley (i.e., the local minimum value) of the feedback voltage trace (i.e., the piezoelectric voltage curve 43). In process 68, EOCF is set equal to the time when the local feedback valley occurs. This is shown as point S4 in the piezoelectric sensor output voltage curve 43 of FIG. 5, which corresponds to point C of injected rate shape curve 39. At this time, needle valve 36 starts to throttle (i.e., starts to close) the nozzle flow out from the fuel injector 10. It is to be understood that although two valleys occur in the piezoelectric (feedback) voltage curve 43, only one valley can occurs on feedback voltage when the piezoelectric actuator 20 is discharged on a slower or equal frequency rate to which the injector hydraulics can react. The above algorithm works well for that scenario except no wait time would be required.

As the needle valve 36 transitions from its full open position to fully closed position, it throttles the nozzle or chokes the flow of fuel. As a result, the body pressure of the injector begins to recover and consequently, as shown by the increasing trend from point S4 to EOI point S5 in the piezoelectric sensor output voltage curve 43 (i.e., sensor feedback signal) of in FIGS. 4 and 5. How fast or slow the needle valve 36 takes to fully shut the injected fuel flow depends on the driver shut down time and hydraulics design in the fuel injector 10.

Figure 7:
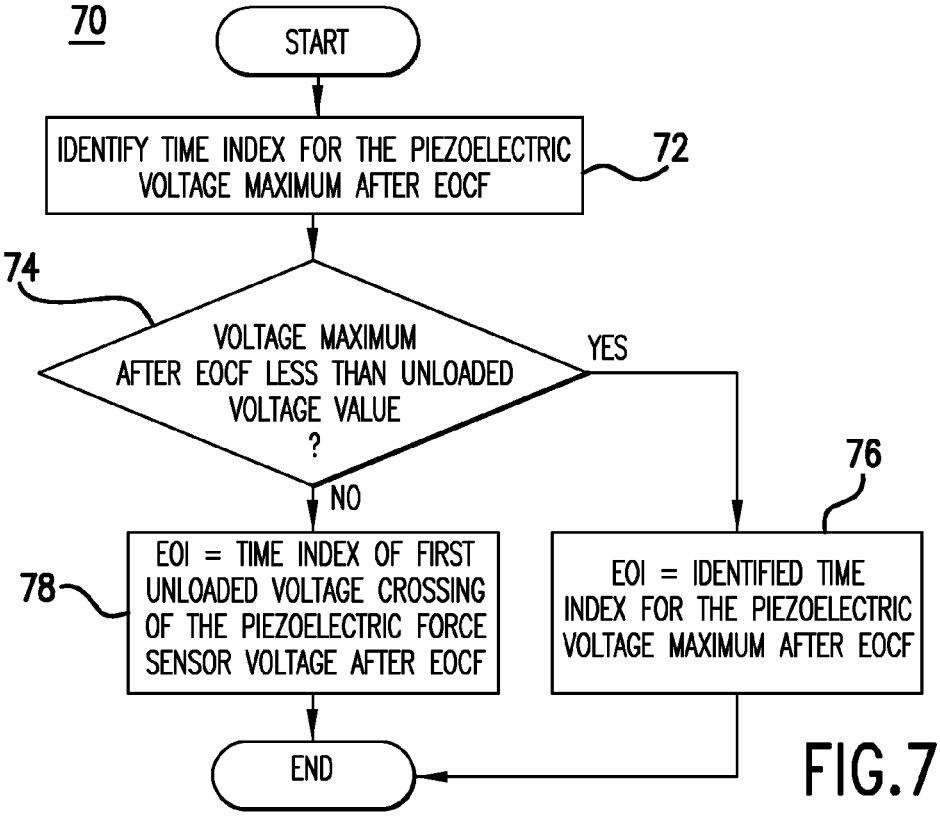
FIG. 7 is a diagram of a process for estimating the timing of the end of injection during a fuel injection event according to an exemplary embodiment.

FIG. 7 shows an exemplary process 70 for estimating the EOI of the fuel injector 10. At process 72, which starts from EOCF time index, a search is performed to identify a localized maximum voltage value of the sensor feedback signal and its corresponding time index. For example, starting from the EOCF time index at point S4 the piezoelectric force sensor output voltage is searched to identify a maximum voltage value localized in a time window of a predetermined size. Next, decision 74 determines if the identified maximum voltage value is less than the unloaded voltage value of the piezoelectric force sensor (e.g., a negative value if the unloaded voltage value is zero or less). If it is, then end of injection, EOI, is set equal to the time index of the identified maximum voltage value. If the identified maximum voltage value is greater than or equal to than the unloaded voltage value, the EOI is set equal to the time index of first crossing of the unloaded voltage value of the piezoelectric force sensor after the EOCF time index, for example, the first "zero crossing" during a predetermined time window. The estimation of the EOI time is shown as the time index of point S5 in FIG. 4, which coincides very well with the time index of point D of the injected rate shape curve 39. The voltage differential between points S4 and S5 is proportional to the motion of the needle valve 36 during closing.

Monitoring the time elapsed between the EOCF and EOI (i.e. the time between points S4 and S5 indicating needle closing travel time) provides information that can be used to diagnose unintended long EOI delay and possibly health states of the injector hardware.

An exemplary method of estimating SOCF will now be explained. This algorithm knows the amplitude change of sensor voltage due to closing of the needle valve 36, as described earlier. Because the injector hydraulic configuration is known and the actuator driving scheme is known by the ECU, therefore, the sensor voltage change due to needle opening is proportional to the change in sensor voltage due to needle closing. The voltage differential between points S4 and S5 is multiplied by a known gain value and then subtracted from the positive peak value at point S2 of the force sensor output (feedback) voltage. This calculated voltage point is shown as point S6 in FIG. 4. The time index of the start of cup flow, SOCF, is determined to be the time index of the calculated voltage point S6.

Also, the height of the cup flow, HOCF, or the magnitude of injected rate shape varies depending on, or is in correspondence with rail pressure. As rail pressure goes up, the HOCF magnitude goes up causing the injector to starve and the consequently the body pressure of the injector goes down. The piezoelectric force sensor 28 reacts to that dropping body pressure and shows voltage drop. The voltage differential between points S6 and S3 is correlated to the height of the injected rate shape. That is, if the voltage differential between points S6 and S3 is small, then the rate shape height, F in FIGS. 2 and 4 would be smaller and vice versa.

Figure 8:
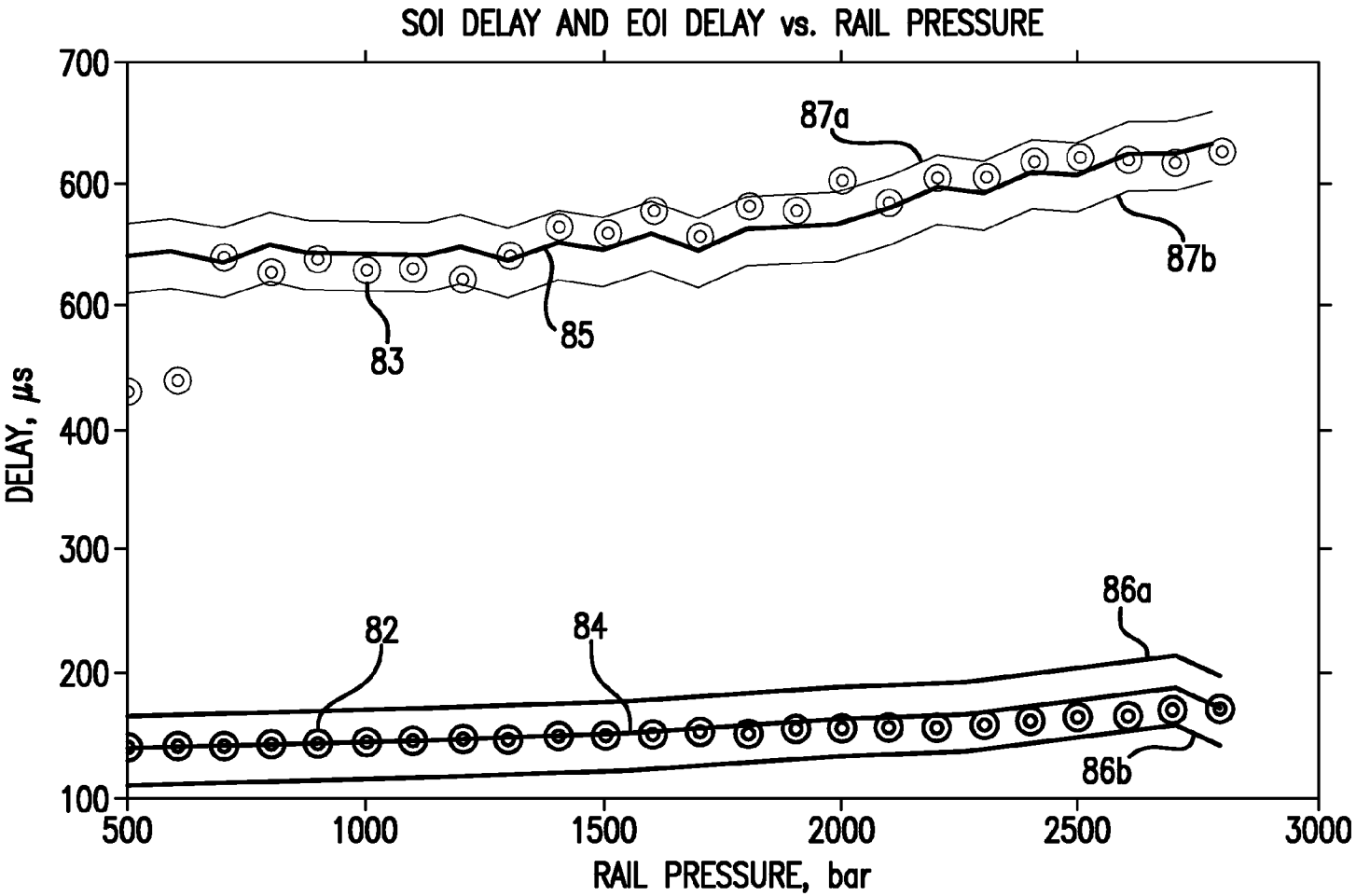
FIG. 8 is a graph showing the accuracy of predicted SOI and EOI event timings over a range of rail pressures.

As can be seen, the output signal from the piezoelectric force sensor 28 can be used by a prediction algorithm to predict injection events, such as SOI and EOI. FIG. 8 shows results of predicted and actual SOI and EOI across an operating pressure map. As shown in FIG. 8, darker dots 82 represent predicted SOI and the lighter dots 83 represent predicted EOI, and the line 84 represents actual SOI and the line 85 represents actual EOI. The lines 86*a*, 86*b* on either side of the actual SOI line 84, and the lines 87*a*, 87*b* on either side of the actual EOI line 85 in both cases represent tolerance boundary (+/−0.25 crank deg) for the associated prediction. As can be seen from FIG. 8, the start and end of injection were estimated well from the piezoelectric force sensor 28 across the operating rail pressure map.

Figure 9:
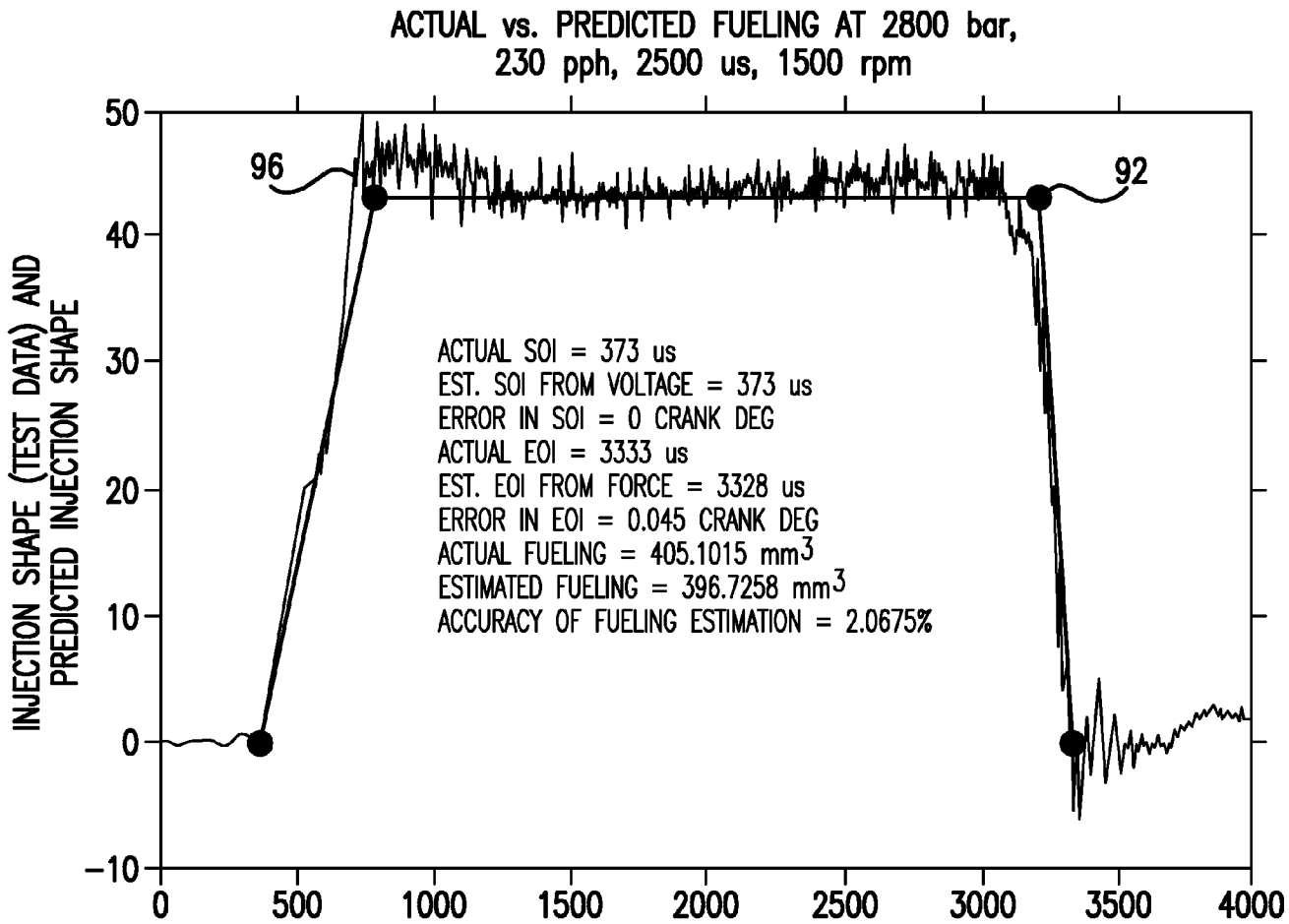
FIG. 9 is graph showing an injection rate shape constructed from estimated SOI, SOCF, EOCF and EOI timings, and from the HOCF value for a fuel injector operating at 2800 bar.
Figure 10:
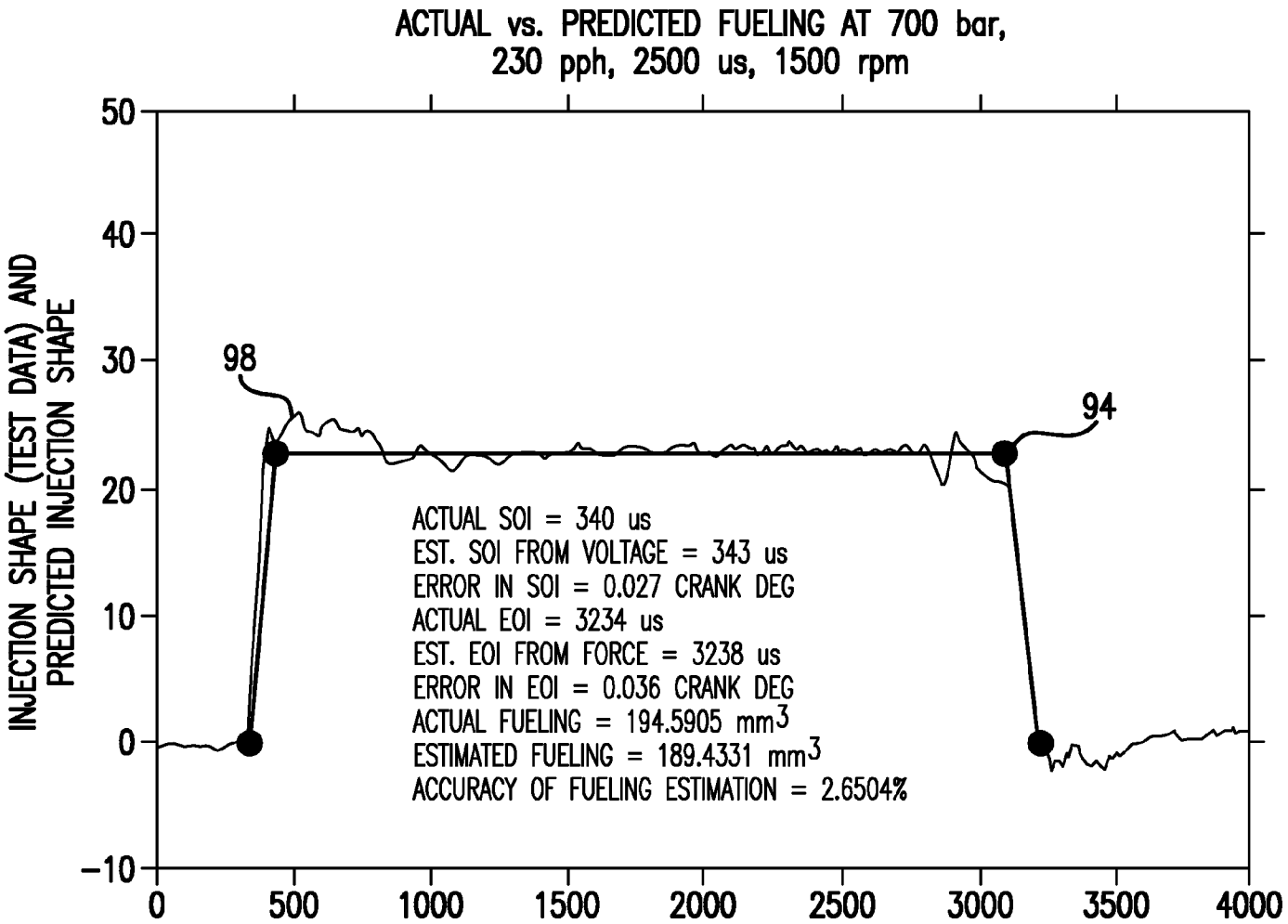
FIG. 10 is graph showing an injection rate shape constructed from estimated SOI, SOCF, EOCF and EOI timings, and from the HOCF value for a fuel injector operating at 700 bar.

The injection rate shape can be constructed as a trapezoidal shape from predicted timings of the SOI, SOCF, EOCF and EOI, and from the HOCF value. Thereafter, the fueling quantity can be calculated by integrating the area under the reconstructed trapezoidal injection shape. The injection rate shape construction and fuel quantity estimation are demonstrated in FIG. 9 and FIG. 10 for a high rail pressure of 2800 bar and low rail pressure of 700 bar, respectively. The trapezoidal trace 92 in FIG. 9 and the trapezoidal trace 94 in FIG. 10 represent predicted rate shapes for the respective rail pressures. Also shown in FIGS. 9 and 10 are superimposed traces 96 and 98, respectively, from actual measurement of injection rate shape. The injection rate shape construction and fuel quantity estimation compares very well with the actual measurement, as can be seen in FIG. 9 and FIG. 10.

Figure 11:
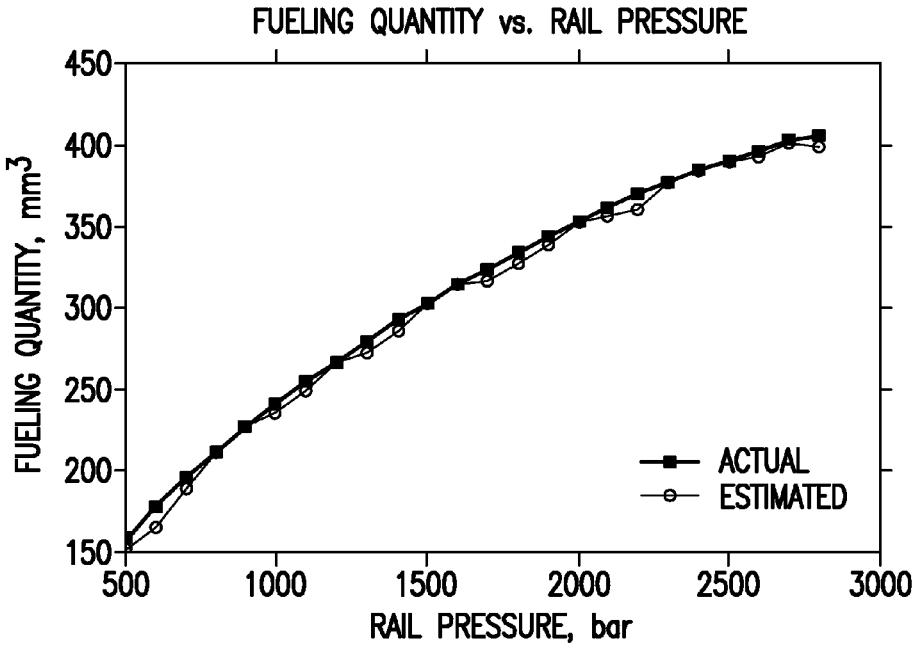
FIG. 11 is a graph showing a curve of actual of fueling quantity data values and a curve of estimated fueling quantity values over a range of rail pressures.

As shown in FIG. 11, each square dot represents the actual of fueling quantity and each circular dot represents an estimation of fueling quantity associated with a rail pressure. As can be seen, FIG. 11 essentially shows a very good correlation of the actual vs. predicted injected fueling quantity across operating rail pressure map.

As explained above, injected fueling characteristics (start/end of injection, fueling quantity etc.) can be accurately predicted for a piezoelectric fuel injector system. Based on these real-time estimations, closed-loop controls can be implemented to account for one or more conditions that can cause unintended variability in the fuel injection system, such as hardware and operating condition variability, deterioration/wear. For example, a controller, such as an engine control module (ECM), also called an engine control unit (ECU), or other controller can include software and/or hardware for performing the prediction algorithm, and include other modules for controlling various parameters of engine operation. The engine controller can receive the signal that is output from the piezoelectric force sensor while it monitors the forces and pressure created in the fuel injector during its operation. These monitored signals can be input into a prediction algorithm that determines prediction values of fueling characteristics, such as SOI, EOI, fueling rate and fueling quantity etc. For example, predicted values determined by the algorithm can be compared with expected values stored in memory or with characteristics of other fuel injectors of the internal combustion engine. The controller can provide adjustments to the operation, such as adjustments to injector timing, duration, and fuel pressure level to meet a performance requirement. Also, estimated fueling characteristics provide real-time the health diagnosis of the piezoelectric actuator stack and mechanical injector components.

Figure 12:
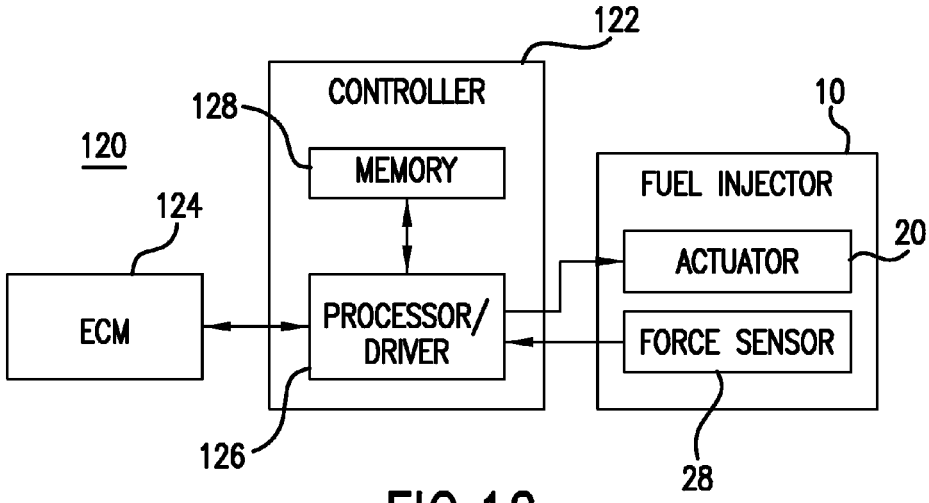
FIG. 12 is a high level diagram of an a fuel system includes a controller according to an exemplary embodiment.

FIG. 12 shows an exemplary embodiment of the fuel system 120 that includes an controller 122 electronically operable to implement the control strategy including, for example, executing logic/instructions, monitoring conditions of the engine, determining values/conditions, and commanding and/or controlling certain aspects of operation of the engine, for example, by controlling certain engine components such as engine throttle, fuel injection timing, the amount of fuel supplied to the engine. The electronic controller may be in communication with various engine and/or vehicle sensors, such as engine throttle, engine speed, engine temperature, engine load, transmission speed, and vehicle speed. The controller 122 may execute routines, for example the processes described herein, to determine or calculate estimated SOI, SOCF, EOCF, EOI and HOCF timings, as described herein. The fuel system 120 can check the thresholds to determine or calculate the appropriate time delay(s) to control fuel injection timing, rate shaping while compensating for variations affecting fuel injection such as manufacturing tolerances, environmental conditions, deterioration/wear and sensor variation. The controller 120 may be formed as an integral part of an engine control module (ECM), as a unit separate from an ECM, or one or more controllers that communicate with an ECM.

In the exemplary embodiment shown in FIG. 12, the controller 122 is separate from, and in communication with an ECM 124. The controller 122 includes a processor/driver 126 in communication with the ECM 122, and a memory 128. The controller 120 also is in communication with the piezoelectric actuator 20 to energize or de-energize the actuator and the piezoelectric force sensor 28 to receive a voltage or current feedback signal in response to sensing longitudinal forces of the actuator 20 and mechanical and hydraulic forces in the body of the fuel injector 10.

While embodiments are described herein using a piezoelectric actuator, the fuel injector actuator may instead be another type of electronically controlled actuator, such as a solenoid or magnetostrictive type, for affecting or controlling either directly or indirectly some or all aspects of the disclosed fuel injection events.

Although a limited number of exemplary embodiments is described herein, one of ordinary skill in the art will readily recognize that there could be variations to any of these embodiments and those variations would be within the scope of the appended claims. Thus, it will be apparent to those skilled in the art that various changes and modifications can be made to the system and method described herein without departing from the scope of the appended claims and their equivalents.

What is claimed is:

1. A piezoelectric-actuated fuel injector system for injecting fuel into a combustion chamber of an internal combustion engine, comprising:

an injector body including a plunger, a nozzle housing having a nozzle cavity, injector body and said nozzle housing, and an injector orifice communicating with one end of said nozzle cavity to inject fuel into the combustion chamber;

a nozzle valve element positioned in said nozzle cavity adjacent said injector orifice, said nozzle valve movable between an open position in which fuel flows through said injector orifice into the combustion chamber and a closed position in which fuel flow through said injector orifice is blocked;

a piezoelectric actuator movable to expand in a first direction and to contract in a second direction;

a hydraulic link assembly positioned within said nozzle cavity, said hydraulic link assembly operably connected with the piezoelectric actuator such that movement of the piezoelectric actuator in the first direction causes the nozzle valve element to move to said open position and movement of said piezoelectric actuator in said second direction causes the valve element to move to said closed position; and a force sensor positioned between said piezoelectric actuator and said hydraulic link assembly, said force sensor adapted to provide a signal indicative of forces between the piezoelectric actuator and the hydraulic link assembly during a fuel injection period;

a controller adapted to receive the signal provided by the force sensor, identify at least one of a maximum value and a valley minima value of the monitored output signal, and estimate timing in the injection period of at least one fueling characteristic based on the at least one identified value.

2. The system according to claim 1, wherein the controller if further adapted to control the fuel injector to adjust at least one fuel injection characteristic based on the estimated timing.

3. The system according to claim 1, wherein the at least one fueling characteristic is at least one of start of injection, end of injection, start of cup flow, and end of cup flow.

4. The system according to claim 1, wherein the controller is further adapted to:

monitor the current of the piezoelectric actuator; and identify a time at which a current valley minimum of the piezoelectric actuator current occurs, wherein identification of the local valley voltage minimum value comprises identifying first local minimum of the monitored output signal of the force sensor that occurs after the time of the current valley minimum in the injection period.

5. The system according to claim 4, wherein identifying at least one of a maximum value comprises:

identifying a voltage maximum value of the monitored output signal of the force sensor at a time in the injection period after identifying the local valley voltage minimum value.

6. The system according to claim 5, wherein the controller is adapted to estimate the time of end of injection as the time of the voltage maximum if the identified voltage maximum is less than an unloaded voltage value of the force sensor; and the controller is adapted to estimate the time of end of injection as the first crossing of the unloaded voltage value after the time of the local valley minimum value if the identified voltage maximum is greater than or equal to the unloaded voltage value of the force sensor.

7. The system according to claim 5, wherein estimating timing in the injection period of at least one fueling characteristic based on the at least one identified value comprises determining a start of cup flow timing based on the difference between the identified voltage maximum value and the identified local valley voltage minimum value.

8. The system according to claim 1, wherein estimating timing in the injection period of at least one fueling characteristic based on the at least one identified value comprises identifying the time of the maximum value of the monitored sensor output signal as an estimated time of start of injection.

9. A method of estimating timing characteristics of a fuel injection event of a piezoelectric-actuated fuel injector, said piezoelectric-actuated fuel injector including a force sensor positioned between a piezoelectric actuator and a hydraulic link assembly mechanically coupled with the piezoelectric actuator, said force sensor operable to output a signal corresponding to forces between the piezoelectric actuator and the hydraulic link assembly, said method comprising:

monitoring a signal output from the force sensor the over an injection period of the piezoelectric-actuated fuel injector;

identifying at least one of a maximum value and a local valley minimum value of the monitored output signal; and estimating timing in the injection period of at least one fueling characteristic based on the at least one identified value.

10. The method according to claim 9, further comprising:

controlling the fuel injector to adjust at least one fuel injection characteristic based on the estimated timing.

11. The method according to claim 9, wherein the at least one fueling characteristic is at least one of start of injection, end of injection, start of cup flow, and end of cup flow.

12. The method according to claim 9, further comprising:

monitoring the current of the piezoelectric actuator; and identifying a time at which a current valley minimum of the piezoelectric actuator current occurs, wherein identifying the local valley voltage minimum value comprises identifying first local minimum of the monitored output signal of the force sensor that occurs after the time of the current valley minimum in the injection period.

13. The method according to claim 12, wherein identifying at least one of a maximum value comprises:

identifying a voltage maximum value of the monitored output signal of the force sensor at a time in the injection period after identifying the local valley voltage minimum value.

14. The method according to claim 13, wherein if the identified voltage maximum is less than an unloaded voltage value of the force sensor, estimating the time of end of injection as the time of the voltage maximum; and if the identified voltage maximum is greater than or equal to the unloaded voltage value of the force sensor, estimating the time of end of injection as the first crossing of the unloaded voltage value after the time of the local valley minimum value.

15. The method according to claim 13, wherein estimating timing in the injection period of at least one fueling characteristic based on the at least one identified value comprises determining a start of cup flow timing based on the difference between the identified voltage maximum value and the identified local valley voltage minimum value.

16. The method according to claim 9, wherein estimating timing in the injection period of at least one fueling characteristic based on the at least one identified value comprises identifying the time of the maximum value of the monitored sensor output signal as an estimated time of start of injection.

* * * * *